United States Patent [19]

Everett

[11] Patent Number: 4,684,450

[45] Date of Patent: Aug. 4, 1987

[54] PRODUCTION OF ZINC FROM ORES AND CONCENTRATES

[75] Inventor: Peter K. Everett, Chatswood, Australia

[73] Assignee: Dextec Metallurgical Pty. Ltd., North Sydney, Australia

[21] Appl. No.: 871,402

[22] PCT Filed: Sep. 20, 1985

[86] PCT No.: PCT/AU85/00230

§ 371 Date: May 6, 1986

§ 102(e) Date: May 6, 1986

[87] PCT Pub. No.: WO86/02107

PCT Pub. Date: Apr. 10, 1986

[30] Foreign Application Priority Data

Oct. 5, 1984 [AU] Australia ..... PG7516

[51] Int. Cl.[4] ..... C25C 1/14

[52] U.S. Cl. ..... 204/118; 75/109

[58] Field of Search ..... 204/118; 75/109

[56] References Cited

U.S. PATENT DOCUMENTS 3,772,003 11/1973 Gordy ..... 204/118
4,148,698 4/1979 Everett ..... 204/118
4,288,304 9/1981 De Marthe et al. ..... 204/118
4,465,569 8/1984 Bjune et al. ..... 204/118
4,536,214 8/1985 Ochs et al. ..... 204/118

*Primary Examiner*—R. L. Andrews
*Attorney, Agent, or Firm*—Schwartz, Jeffery, Schwaab, Mack, Blumenthal & Evans

[57] ABSTRACT

Recovering zinc from zinc bearing ore or concentrate (1) in an electrolic cell (3) which includes a cathode (5) containing cathode compartment (16) and an anode (4) containing anode compartment (2). The cathode and anode compartments are defined by interposing between such compartments an ion-selective membrane (6) capable of preventing migration of ionic copper from anode compartment (2) to cathode compartment (16). Process includes forming in anode compartment (2) a slurry of ore or concentrate (1) with a chloride and copper-ion containing solution, intimately mixing oxygen bearing gas (7) with the slurry, maintaining the mixture substantially at atmospheric pressure and at a temperature up to the boiling point of the solution, and maintaining the pH of the mixture from 1 to 4. The resultant solution is rich in solubilized zinc. At least a portion of the mixture is withdrawn and resultant solution (12) separated therefrom. Zinc bearing ore or concentrate (1) is contacted with solution (12) precipitating ionic copper therefrom. Resultant solution (15) is introduced to the cathode compartment (16) and zinc electrochemically recovered at the cathode (5).

11 Claims, 1 Drawing Figure

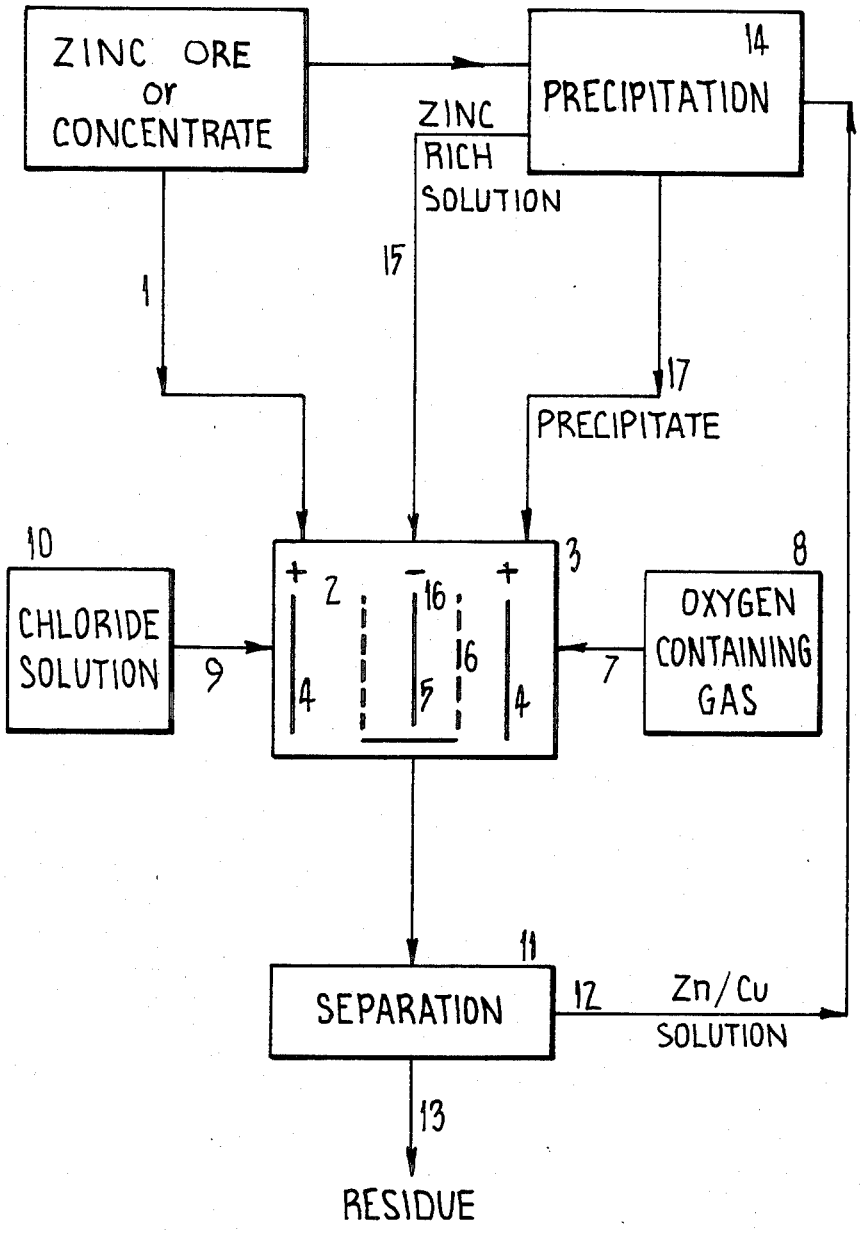
ZINC ORE
or
CONCENTRATE
14
PRECIPITATION
ZINC
RICH
SOLUTION
15
1
17
PRECIPITATE
10
CHLORIDE
SOLUTION
9
+
2
−
16
+
3
4
5
16
4
8
OXYGEN
CONTAINING
GAS
7
11
SEPARATION
12
Zn/Cu
SOLUTION
13
RESIDUE

PRODUCTION OF ZINC FROM ORES AND CONCENTRATES

FIELD OF THE INVENTION

BACKGROUND OF THE INVENTION

The invention relates to the hydrometallurgical production of zinc from zinc bearing ores and concentrates. The sulphide is the more common form of zinc which creates a problem of atmospheric pollution with sulphur dioxide, but zinc in the form of carbonates and oxides may also be treated by this method and can be treated more efficiently in some cases than the sulphides.

DESCRIPTION OF THE PRIOR ART

The conventional method of treating zinc sulphides is by roasting to produce zinc oxide and sulphur dioxide. This sulphuric dioxide may or may not be converted to sulphuric acid. Thereafter the produce is subject to dissolution in sulphuric acid and electrolysis of the purified solution takes place to produce zinc at the cathode and oxygen at the anode. Because of the generation of acid at the anode and the tendency to evolve hydrogen at the cathode rather than zinc, extremely pure solutions must be used and careful control of the current density must be exercised. This requires the addition of reagents to the electrolyte to produce a smooth plate rather than a rough plate or powder, which, under those cell conditions would encourage evolution of hydrogen.

In U.S. Pat. No. 4,148,698 Everett, there is disclosed an alternate method of extracting a base metal from a base metal bearing ore which relies on a cyclic process. It entails the formation of a slurry of the ore with a chloride leaching agent in the presence of ionic copper catalyst. Oxygen is used to enhance the dissolution of the base metal.

Because of the very small amounts of zinc which could be leached per volume of low acid anolyte from the plating cell, large circulation rates were required resulting in expensive solid liquid separation steps. The acid anolyte made plating of zinc in the catholyte difficult due to the ease of migration of hydrogen ions through the diaphragm, even when ion selective membranes such as Nafion (Dupont trade mark) were used.

Zinc has also been produced from chloride solutions with evolution of chlorine at the anode. This requires a high anode potential, expensive anodes (platinum or ruthenium coated titanium) and results in material handling difficulties due to the potential for zinc and chlorine to react explosively. The anolyte is also acidic providing a source of hydrogen ions, normally the main cause of inefficient zinc plating.

The process of this invention overcomes the disadvantages of the above processes and allows the leaching and plating of zinc in a low hydrogen ion environment. This increases the efficiency of plating of the zinc and allows the plating of a powder rather than an adherant plate which would require the addition of plating additives which may have a deleterious effect on the leaching reactions. The anolyte and catholyte are separated by an ion selective membrance (such as Nafion) and the current is passed by the passage through the membrane of ions such as sodium which do not interfere with zinc plating. Hydrogen ions will also pass through these diaphragms and interfere with zinc plating, and it is a particular object of this invention to leach the mineral in a low acid environment to avoid the high cost of low zinc plating efficiency.

SUMMARY OF THE INVENTION

This invention provides a process for recovering zinc from a zinc bearing ore or concentrate in an electrolytic cell, the cell including a cathode compartment containing a cathode, and an anode compartment containing an anode, the cathode and anode compartments defined by interposing an ion selective membrane therebetween, which membrane is characterized as capable of preventing migration of ions which may interfere with zinc plating from the anode compartment to the cathode compartment, the process including forming in the anode compartment, a slurry of the ore or concentrate with a solution containing chloride ions and copper ions, intimately mixing oxygen bearing gas with the slurry, maintaining the mixture substantially at atmospheric pressure and at a temperature up to the boiling point of the solution, and maintaining the pH of the mixture from 1 to 4, whereby the resultant solution is rich in solubilized zinc, withdrawing at least a portion of the mixture and separating the resultant solution therefrom, contacting the resultant solution with zinc bearing ore or concentrate whereby ionic copper is precipitated therefrom, introducing the solution to the cathode compartment and electrochemically recovering zinc at the cathode. Optionally the liquid in the resultant solution may be separated from the mineral and the resulting solution contacted with zinc metal for further purification.

The invention improves over the prior processes as all the dissolution and recovery of zinc occurs in a single cell using an ion selective membrane such as Nafion. There is no need to have a high solution flow because the leaching which is carried out continually consumes the hydrogen ions produced in the cell. Further the invention is conducive to allowing easy recirculation of ionic copper catalyst with minimal losses. This process also enables the anolyte to be operative in a low acid environment without generation of chlorine thereby allowing use of inexpensive graphite anodes due to the low oxidation potential, compared with chlorine or oxygen evolution, which also contributes to a low cell voltage and hence power costs. A further advantage is that any iron leached is oxidised to the ferric form and then hydrolyses to form goethite or acagenite and so avoiding iron contamination of the electrolyte. The use of the low acid anolyte, compared with the prior art, increases zinc plating efficiency and reduces power costs, the most important component of cost in zinc production.

PREFERRED ASPECTS OF THE INVENTION

In a first preferred aspect of the invention it is convenient to utilize the zinc bearing ore or concentrate upon which the ionic copper is precipitated as part of the feed into the anode compartment. Accordingly, redissolution of the copper occurs without the need to separately add substantial amounts of catalyst.

In a further preferred embodiment the pH of the mixture in the anode compartment is from 2.5 to 3.5 and most preferably 3. As indicated earlier, the use of the low acid environment facilitates the elimination of hydrogen evolution in the cathode compartment and generation of chlorine in the anode compartment, prevented by the reducing power of the mineral slurry.

In a further preferred embodiment the temperature of the solution in the anode compartment is from 50° C. up to the boiling point of the solution preferably, from 70°to 100° C. and most preferred from 85° C. to 95° C.

Ionic copper is present as a catalyst for the leaching of zinc bearing ores or concentrates and typically is added in concentrations of about 5 to 25 grams per liter.

The source of chloride in the leach solution may be sodium chloride or other alkali or alkaline earth chlorides. Typically, sodium chloride is used in concentrations of about 200–300 grams per liter. In the precipitation step of copper onto a sulphide ore or concentrate, it should be understood that precipitation may take place on minerals other than sphalerite, examples being galena, pyrrhotite and chalcopyrite. The following examples show the process applied to zinc bearing ores. It is possible, of course, that other base metals may be present in the ores or have been previously removed using processes such as is set out in U.S. Pat. No. 4,148,698.

The process of the invention relies on the anolyte and catholyte reactions being separated by an ion selective membrane.

This allows the use of ionic copper to catalyse anodic oxidation in the anolyte and purified zinc solutions for cathodic reduction in the catholyte according to the equations below.

$$\text{ANODE: } Cu^{+} \longrightarrow Cu^{2+} + e^{-}$$

$$Zns + 2\,Cu^{2+} \longrightarrow Zn^{2+} + 2Cu^{+} + S^{o}$$

$$\text{CATHODE: } Zn^{2+} + 2e^{-} \longrightarrow Zn^{o}$$

Electrical neutrality is maintained by the migration of $Na^{+}$ ions across the ion selective membrane.

EXAMPLE 1

| IONIC COPPER PRECIPITATION | | | |
|---|---|---|---|
| TIME | TEMP | pH | $Cu/Cu^{2+}$ |
| $0^{-}$ | 55 | 2.8 | 22.0/2.8 |
| $0^{+}$ | 65 | 4.3 | 18.8/2.9 |
| ½ | 83 | 4.4 | 2.1/2.0 |
| 1 | 86 | 4.7 | 0.05/0.2 |
| 1½ | 86 | 4.6 | 0.02/0.04 |
| 2 | — | — | .008/0.02 |

FEED: Sphalerite concentrate with 0.7% Cu
RESIDUE: 4.6% Cu
SLURRY DENSITY: 50% w/w The above table illustrates the effectiveness of ionic copper recovery by precipitation upon Sphalerite.

EXAMPLE 2

| 50 LITER CELL RESULTS | | | | | | | | | | |
|---|---|---|---|---|---|---|---|---|---|---|
| FEED: | Sphalerite conc. | | | NOMINAL CURRENT: | | | 60 amps | | | |
| ELECTROLYTE: | S.G. 1.21<br>250 gpl NaCl<br>60 gpl $Zn^{++}$ | | | SLURRY DENSITY: | | | 1000 g/401<br>2% w/w | | | |
| TIME (HRS) | $0^{+}$ | 1 | 2 | 3 | 4 | 5 | 6 | 7 | 8 | O/N |
| AIR FLOW (L/MIN) | 1.5 | 1.5 | 1.5 | 1.52 | 3.5 | 3.5 | 3.5 | 3.0 | 3.0 | |
| TEMP °C. | 90 | 88 | 90 | 90 | 90 | 90 | 91 | 90 | 90 | 90 |
| CELL VOLTAGE | 2.34 | 2.18 | 2.15 | 2.14 | 2.18 | 2.90 | 3.13 | 2.95 | 3.18 | |
| ANOLYTE ANALYSES | | | | | | | | | | |
| Zn gpl | 58.0 | 60.0 | 64.0 | 62.4 | 63.6 | 62.4 | 63.6 | 63.6 | 61.2 | 61.2 |
| Cu gpl | 17.2 | 16.4 | 16.4 | 16.4 | 15.2 | 14.4 | 17.2 | 17.6 | 17.6 | 16.8 |
| $Cu^{++}$ gpl | 3.5 | 4.6 | 5.1 | 4.8 | 6.1 | 10.1 | 17.2 | 17.6 | — | — |
| Fe gpl | 0.02 | 0.02 | 0.02 | 0.02 | 0.02 | 0.01 | 0.07 | 0.8 | 1.1 | 1.7 |
| pH | 3.4 | 3.1 | 3.1 | 2.9 | 2.8 | 2.6 | 1.3 | 0.6 | 0.5 | 1.6 |
| CATHOLYTE ANALYSES | | | | | | | | | | |
| Zn gpl | 61.0 | 38.0 | 47.0 | 49.2 | 44.4 | 57.6 | 46.2 | 42.0 | 42.6 | |
| pH | 6.2 | 6.5 | 6.5 | 6.2 | 6.3 | 6.0 | 6.2 | 6.2 | 6.4 | |
| SOLIDS ANALYSIS | % Zn | % Fe | % Cu | % Pb | | | | | | |
| FEED | 36.0 | 13.8 | 0.2 | 0.02 | | | | | | |
| FINAL | 1.7 | 14.8 | 0.1 | 0.01 | | | | | | |
| % RECOVERY | 97 | | | | | | | | | |

POWER CONSUMPTION: 2.5 KWH/kg

EXAMPLE 3

| 50 LITER CELL RESULTS | | | | | | | |
|---|---|---|---|---|---|---|---|
| FEED: | Sphalerite conc. | NOMINAL CURRENT: | | | 40 amps | | |
| ELECTROLYTE: | S.G. 1.2<br>250 gpl NaCl<br>60 gpl $Zn^{2+}$ | SLURRY DENSITY: | | | 800 g/401<br>1.6% w/w | | |
| TIME (HRS) | $0^{+}$ | 1 | 2 | 3 | 4 | 5 | 6 |
| AIR FLOW (L/MIN) | 2.5 | 0.5 | 1 | 1 | 1 | 2 | 2 |
| TEMP °C. | 90 | 89.5 | 90 | 89 | 90 | 89.6 | 90 |
| CELL VOLTAGE | 1.98 | 2.72 | 2.81 | 2.98 | 3.10 | 3.22 | 3.24 |
| ANOLYTE ANALYSES | | | | | | | |
| Zn gpl | 56.4 | 58.8 | 60.0 | 66.0 | 69.6 | 68.4 | 69.6 |
| Cu gpl | 8.3 | 8.2 | 8.2 | 8.6 | 8.6 | 8.5 | 8.8 |
| $Cu^{++}$ gpl | 4.2 | 2.4 | 2.2 | 2.2 | 2.5 | 2.7 | 4.6 |
| Fe gpl | 0.3 | 0.3 | 0.4 | 0.6 | 0.7 | 0.7 | 0.6 |
| pH | 2.2 | 2.5 | 2.1 | 2.3 | 2.0 | 2.0 | 2.0 |

-continued

| 50 LITER·CELL RESULTS | | | | | | | |
|---|---|---|---|---|---|---|---|
| CATHOLYTE ANALYSES | | | | | | | |
| Zn gpl | 46.8 | 46.2 | 44.4 | 43.2 | 43.8 | 45.0 | 45.0 |
| pH | 5.2 | 5.8 | 6.0 | 6.3 | 6.5 | 6.3 | 6.5 |
| SOLIDS ANALYSIS | % Zn | % Fe | % Cu | % Pb | | | |
| FEED | 36.0 | 8.2 | 0.7 | 4.6 | | | |
| FINAL | 10.1 | 10.6 | 0.9 | 0.05 | | | |
| % RECOVERY | 70 | | | | | | |

POWER CONSUMPTION: 2.75 KWH/kg

EXAMPLE 4

| 50 LITER CELL RESULTS | | | | | | | |
|---|---|---|---|---|---|---|---|
| FEED: | Sphalerite conc. | NOMINAL CURRENT: | | | | 60 amps | |
| ELECTROLYTE: | S.G. 1.2<br>250 gpl NaCl<br>60 gpl $Zn^{++}$ | SLURRY DENSITY: | | | | 3.5 kg/401<br>6.9% w/w | |
| TIME (HRS) | $0^{+}$ | 2 | 4 | 6 | 8 | 10 | 12 |
| AIR FLOW (L/MIN) | 2 | 1 | 2 | 1 | 0.5 | 0.5 | 0.5 |
| TEMP °C. | 90 | 90 | 90 | 90 | 90 | 90 | 90 |
| CELL VOLTAGE | 2.40 | 2.48 | 2.71 | 3.21 | 3.40 | 3.50 | 3.50 |
| ANOLYTE ANALYSES | | | | | | | |
| Zn gpl | 54.0 | 57.6 | 58.8 | 64.8 | 69.6 | 74.4 | 78.0 |
| Cu gpl | 17.6 | 18.4 | 16.8 | 16.8 | 16.4 | 16.4 | 16.8 |
| $Cu^{++}$ gpl | 3.0 | 3.8 | 3.5 | — | 3.8 | 4.2 | 4.3 |
| Fe gpl | 0.02 | 0.03 | 0.03 | 0.08 | 0.2 | 0.2 | 0.09 |
| pH | 3.6 | 3.4 | 2.5 | 2.8 | 2.2 | 2.6 | 2.8 |
| CATHOLYTE ANALYSES | | | | | | | |
| Zn gpl | 29.4 | 24.0 | 28.8 | 26.4 | 28.0 | 31.8 | 37.8 |
| pH | 6.5 | 6.8 | 6.8 | 6.9 | 6.1 | 6.3 | 6.4 |
| SOLIDS ANALYSIS | % Zn | % Fe | % Cu | % Pb | | | |
| FEED | 37.8 | 13.0 | 0.8 | 0.5 | | | |
| FINAL | 11.2 | 20.9 | 3.8 | 0.03 | | | |
| % RECOVERY | 70 | | | | | | |

POWER CONSUMPTION: 2.2 KWH/kg

EXAMPLE 5

| 50 LITER CELL RESULTS | | | | | | | |
|---|---|---|---|---|---|---|---|
| FEED: | Sphalerite conc. | NOMINAL CURRENT: | | | | 60 amps | |
| ELECTROLYTE: | S.G. 1.2<br>250 gpl NaCl<br>60 gpl $Zn^{++}$ | SLURRY DENSITY: | | | | 840 g/401<br>1.7% w/w | |
| TIME (HRS) | $0^{+}$ | 1 | 2 | 3 | 4 | 5 | 6 |
| AIR FLOW (L/MIN) | 2 | 2 | 2 | 2 | 4 | 6 | 6 |
| TEMP °C. | 50 | 50 | 50 | 50 | 50 | 50 | 50 |
| CELL VOLTAGE | 3.36 | 3.28 | 3.43 | 3.27 | 3.19 | 3.03 | 2.92 |
| ANOLYTE ANALYSES | | | | | | | |
| Zn gpl | 60.0 | 62.0 | 62.0 | 58.0 | 60.0 | 60.0 | 60.0 |
| Cu gpl | 13.2 | 13.6 | 13.2 | 13.6 | 13.6 | 13.6 | 14.0 |
| $Cu^{++}$ gpl | 2.6 | 4.3 | 6.2 | 13.6 | 13.6 | 13.6 | 14.0 |
| Fe gpl | 1.0 | 0.9 | 0.8 | 1.0 | 1.4 | 1.4 | 1.5 |
| pH | 0.3 | 0.7 | 1.0 | 0.5 | 0.0 | 0.0 | 0.2 |
| CATHOLYTE ANALYSES | | | | | | | |
| Zn gpl | 56.0 | 50.1 | 47.0 | 41.0 | 41.0 | 42.0 | 40.0 |
| pH | 6.5 | 6.7 | 6.8 | 6.8 | 6.7 | 6.7 | 6.7 |
| SOLIDS ANALYSIS | % Zn | % Cu | % Fe | % Pb | | | |
| FEED | 42.0 | 0.2 | 8.3 | 0.05 | | | |
| RESIDUE | 38.4 | 0.1 | 7.5 | 0.02 | | | |
| % RECOVERY | 9 | | | | | | |

POWER CONSUMPTION: 45 KWH/kg

The experiment of example 2 was repeated at a temperature of 50° C. The ionic copper was all in the cupric state after 3 hours and the pH dropped to less than 1.0 with hydrogen evolution at the cathode, indicating the lack of reactivity at that temperature.

EXAMPLE 6

| 50 LITER CELL RESULTS | | | |
|---|---|---|---|
| FEED: | Sphalerite conc. | NOMINAL CURRENT: | 60 amps |
| ELECTROLYTE: | S.G. 1.228<br>250 gpl NaCl | SLURRY DENSITY: | 890 g/401<br>1.8% w/w |

-continued

| 50 LITER CELL RESULTS | | | | | | | | |
|---|---|---|---|---|---|---|---|---|
| 50-60 gpl $Zn^{++}$ | | | | | | | | |
| TIME (HRS) | 0+ | 1 | 2 | 3 | 4 | 5 | 5.5 | 6 |
| AIR FLOW (L/MIN) | 0.5 | 0.5 | 0.5 | 1 | 1 | 1 | 1 | 2 |
| TEMP °C. | 75 | 75 | 75 | 75 | 70 | 70 | 70 | 70 |
| CELL VOLTAGE | 2.28 | 2.15 | 2.14 | 2.62 | 2.71 | 2.78 | 2.80 | 2.81 |
| ANOLYTE ANALYSES | | | | | | | | |
| gpl Zn | 50.4 | 52.8 | 54.0 | 57.6 | 56.4 | 57.6 | 57.6 | 57.6 |
| gpl Cu | 14.8 | 15.2 | 15.6 | 16.0 | 15.6 | 15.6 | 15.2 | 15.6 |
| gpl $Cu^{++}$ | 3.8 | 4.2 | 3.4 | 6.9 | 7.4 | 8.3 | 9.6 | 12.4 |
| % $Cu^{2+}$ | 26 | 28 | 22 | 43 | 47 | 53 | 63 | 79 |
| gpl Fe | 0.04 | 0.3 | 0.4 | 0.3 | 0.5 | 0.6 | 0.6 | 0.6 |
| pH | 2.9 | 3.2 | 2.3 | 2.5 | 2.0 | 2.5 | 2.0 | 1.6 |
| CATHOLYTE ANALYSES | | | | | | | | |
| gpl Zn | 46.2 | 60.0 | 64.8 | 46.6 | 46.8 | 46.8 | 47.2 | 45.6 |
| pH | 5.8 | 5.7 | 5.2 | 6.0 | 6.2 | 6.3 | 6.3 | 6.3 |
| SOLIDS ANALYSIS | % Zn | % Fe | % Cu | % Pb | | | | |
| FEED | 42.6 | 10.4 | 0.2 | 0.05 | | | | |
| FINAL | 30.0 | 8.4 | 0.1 | 0.03 | | | | |
| % RECOVERY | 30 | | | | | | | |

POWER CONSUMPTION: 8.2 KWH/kg

The experiment of example 2 was repeated at an initial temperature of 75° C. and subsequently lowered to 70° C. After 3 at 75° C. the proportion of ionic copper present in the cupric state had increased by only 17% while the pH was controlled in the range 2.5 to 3.5 with air addition. Once the temperature was lowered to 70° C., from 4 to 6 hours, the increase in the proportion of ionic copper in the cupric state rose more sharply by 32% while the pH tended to drop inspite of increased air addition. These results indicate that reactivity is adequate at 75° C. but is marginal at 70° C.

BRIEF DESCRIPTION OF THE DRAWINGS

FIG. 1 is a schematic representation of apparatus and is also a flow-sheet.

Fresh ore 1 is introduced into the anode compartment 2 of an electrochemical cell 3. Cell 3 comprises anodes 4 and cathode 5. Cathode 5 is enveloped by an ion selective membrane 6 which prevents the flow of copper ions from the anode compartment to the cathode compartment. Oxygen bearing gas 7 is introduced into the anode compartment from source 8 and permits intimate mingling of the zinc bearing ore with chloride containing leach solution 9 introduced from source 10. Within the anode compartment 2 zinc metal dissolves from the zinc bearing ore thus going into solution with copper ions introduced into the leach solution either through recirculation or from a separate copper source (not shown).

After a predetermined period of contact between the zinc bearing ore and copper and chloride ions, the resultant slurry is removed from the cell and introduced into a separator 11 in which the solution rich in zinc and copper is separated from the residue 13. A portion of the zinc and copper rich solution 12 is then introduced into a precipitator 14 together with at least a portion of zinc bearing ore or concentrate 1. Contact of these results in copper being substantially precipitated from solution 12 onto the zinc bearing ore or concentrate. The enriched zinc containing solution 15 depleted of copper ions is then passed into the cathode compartment 16 wherein zinc metal is plated upon cathode 5. The residue 17 from precipitator 14 comprising zinc bearing ore or concentrate and precipitated copper is introduced into anode compartment 2 wherein for dissolution of both the copper and zinc.

Accordingly, the invention is conducive to a cylic continuous process which enables both the plating of zinc at the cathode whilst leaching of the base metals in an aerated slurry in the anode compartment of the diaphram cell.

I claim:

1. A process for recovering zinc from a zinc bearing ore or concentrate in an electrolytic cell, the cell including a cathode compartment containing a cathode, and an anode compartment containing an anode, the cathode and anode compartments defined by interposing an ion selective membrane therebetween, the membrane being capable of preventing migration of heavy metal ions which may interfere with the plating of zinc from the anode compartment to the cathode compartment, the process including forming in the anode compartment a slurry of the ore or concentrate with a solution containing chloride ions and copper ions, intimately mixing oxygen bearing gas with the slurry, maintaining the mixture substantially at atmospheric pressure and at a temperature up to the boiling point of the solution, and maintaining the pH of the mixture from 1 to 4 applying electrolysis current to the cell whereby the resultant solution is rich in solubilized zinc, withdrawing at least a portion of the mixture and separating the resultant solution therefrom, contacting the resultant solution with zinc bearing ore or concentrate whereby copper is precipitated therefrom, introducing the resultant solution to the cathode compartment and electrochemically recovering zinc at the cathode.

2. The process of claim 1 comprising the additional step of introducing to the slurry the zinc bearing ore or concentrate and copper precipitate.

3. The process of claim 1 wherein the pH of the mixture is from 2.5 to 3.5.

4. The process of claim 1 wherein the temperature of the solution is from 50° C. up to the boiling point of the solution.

5. The process of claim 1 wherein the temperature of the solution is from 70° C. to 100° C.

6. The process of claim 1 wherein the temperature of the solution is from 85° C. to 95° C.

7. The process according to claim 1 wherein the solution contains about 5 to 25 grams per liter of ionic copper.

8. The process according to claim 1 wherein substantially all the ionic copper present in the resultant solution is precipitated by contact with the zinc bearing ore or concentrate.

9. The process according to claim 8 wherein the zinc bearing ore is a zinc sulphide ore.

10. The process according to claim 9 wherein the zinc sulphide ore additionally contains copper sulphides.

11. The process of claim 1 wherein the chloride ions are added in the form of sodium chloride at concentrations of 200 to 300 grams per liter.

* * * * *

UNITED STATES PATENT AND TRADEMARK OFFICE

CERTIFICATE OF CORRECTION

PATENT NO. : 4,684,450

DATED : August 4, 1987

INVENTOR(S) : Peter K. Everett

It is certified that error appears in the above-identified patent and that said Letters Patent is hereby corrected as shown below:

IN THE ABSTRACT:

Line 2, change "electrolic" to --electrolytic--.

IN THE SPECIFICATION:

Column 1, line 19, change "sulphuric" to --sulphur--.

Column 1, line 20, change "produce" to --product--.

Signed and Sealed this

Twenty-sixth Day of April, 1988

*Attest:*

DONALD J. QUIGG

*Attesting Officer*

*Commissioner of Patents and Trademarks*